US007556556B1

(12) United States Patent
McDonald

(10) Patent No.: US 7,556,556 B1
(45) Date of Patent: Jul. 7, 2009

(54) PIPE PREPARATION APPARATUS

(76) Inventor: Joseph R. McDonald, 2402 S. 8th St., Fort Pierce, FL (US) 34982

( * ) Notice: Subject to any disclaimer, the term of this patent is extended or adjusted under 35 U.S.C. 154(b) by 0 days.

(21) Appl. No.: 12/015,300

(22) Filed: Jan. 16, 2008

(51) Int. Cl.
*B24B 5/40* (2006.01)

(52) U.S. Cl. ..... 451/65; 15/104.095

(58) Field of Classification Search ..... 451/65, 451/66, 69, 70; 15/104.095, 104.04
See application file for complete search history.

(56) References Cited

U.S. PATENT DOCUMENTS 3,067,443 A * 12/1962 Romens et al. ..... 15/21.1
3,355,749 A 12/1967 Steffen
4,349,928 A 9/1982 Mlikotin
4,791,693 A * 12/1988 Kvaternik ..... 15/3.17
D356,213 S 3/1995 Chaves
5,829,142 A * 11/1998 Rieser ..... 30/93
5,937,470 A * 8/1999 Duncan ..... 15/88
6,014,810 A 1/2000 Earle et al.
6,106,370 A 8/2000 Carter
6,336,270 B1 * 1/2002 Dureiko ..... 30/102
6,698,048 B1 3/2004 Greene

* cited by examiner

*Primary Examiner*—Robert Rose

(57) ABSTRACT

A pipe preparation apparatus includes a housing that has a first wall, a second wall and a peripheral wall. A drive assembly is mounted in the housing. A plurality of scouring sleeves is mechanically coupled to the drive assembly. The sleeves have an inner surface comprising a plurality of bristles. A pipe is extended into one of the sleeves and scoured and cleaned by the bristles. Each of a plurality of cleaning brushes includes a post has a first end and a second end and a plurality of bristles attached to the post adjacent to the first end. The second ends are removably coupled to the drive assembly so that the posts are rotated about their axis when the drive assembly is turned on. The bristles are extendable into a pipe to scour and clean an inner surface of the pipe.

13 Claims, 8 Drawing Sheets

PIPE PREPARATION APPARATUS

BACKGROUND OF THE INVENTION

Field of the Invention

The present invention relates to pipe cleaning and scoring devices and more particularly pertains to a new pipe cleaning and scoring device for preparing a pipe to be welded to another pipe or pipe connector.

SUMMARY OF THE INVENTION

The present invention meets the needs presented above by generally comprising a housing that has a first wall, a second wall and a peripheral wall that is attached to and extends between the first and second walls. A drive assembly is mounted in the housing. A plurality of scouring sleeves is mechanically coupled to the drive assembly and is rotated about an axis of the sleeves when the drive assembly is turned on. Each of the sleeves has an inner surface comprising a plurality of inwardly extending bristles. A pipe is extended into one of the sleeves and scoured and cleaned by the bristles rotating around an outer surface of the pipe. Each of a plurality of cleaning brushes includes a post has a first end and a second end and a plurality of bristles attached to the post adjacent to the first end. The second ends are removably coupled to the drive assembly so that the posts are rotated about their axis when the drive assembly is turned on. The bristles are extendable into a pipe or pipe connector to scour and clean an inner surface of the pipe or pipe connector.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
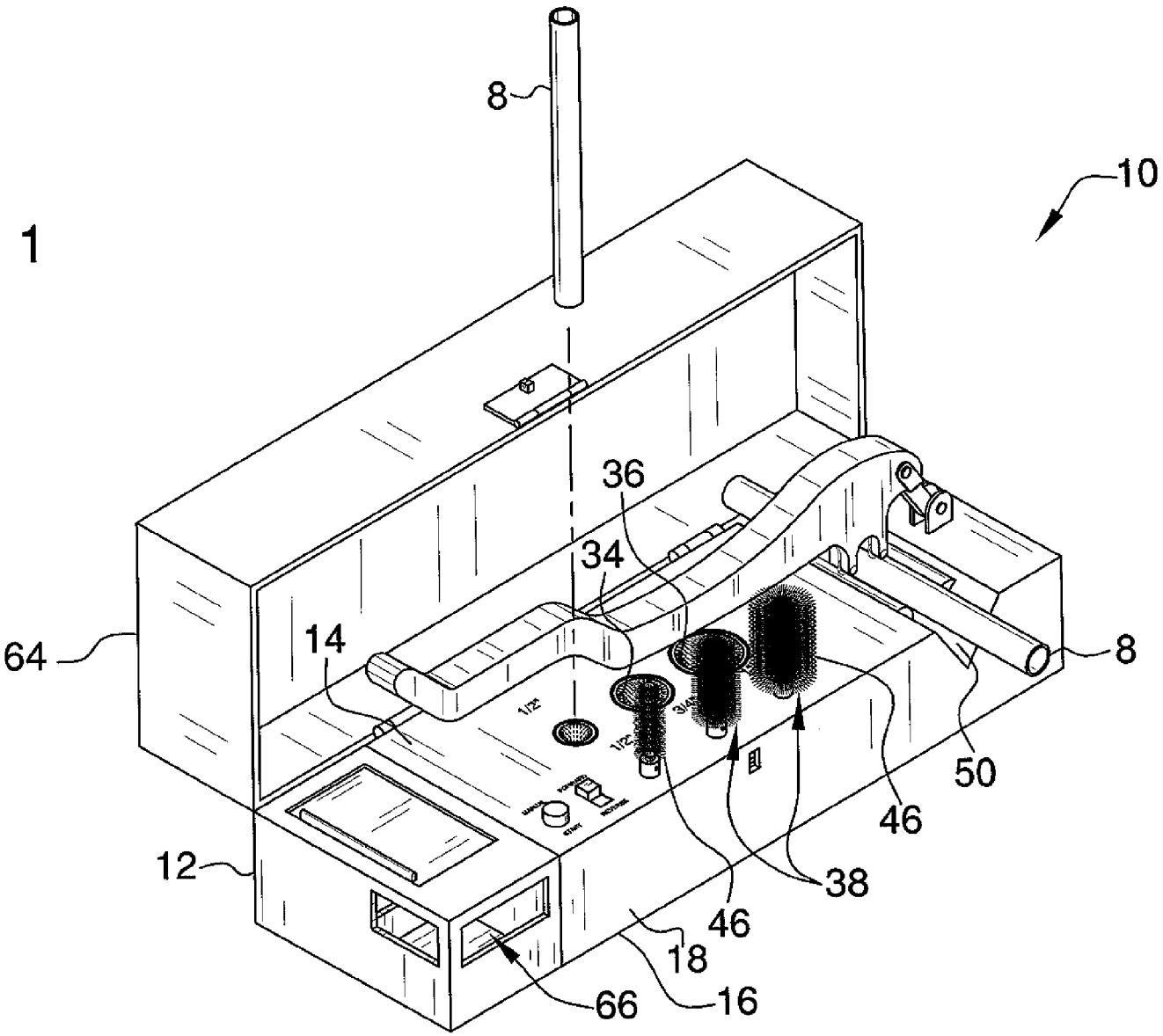
FIG. 1 is a top perspective view of a pipe preparation apparatus according to the present invention with a cover in an open position.
Figure 2:
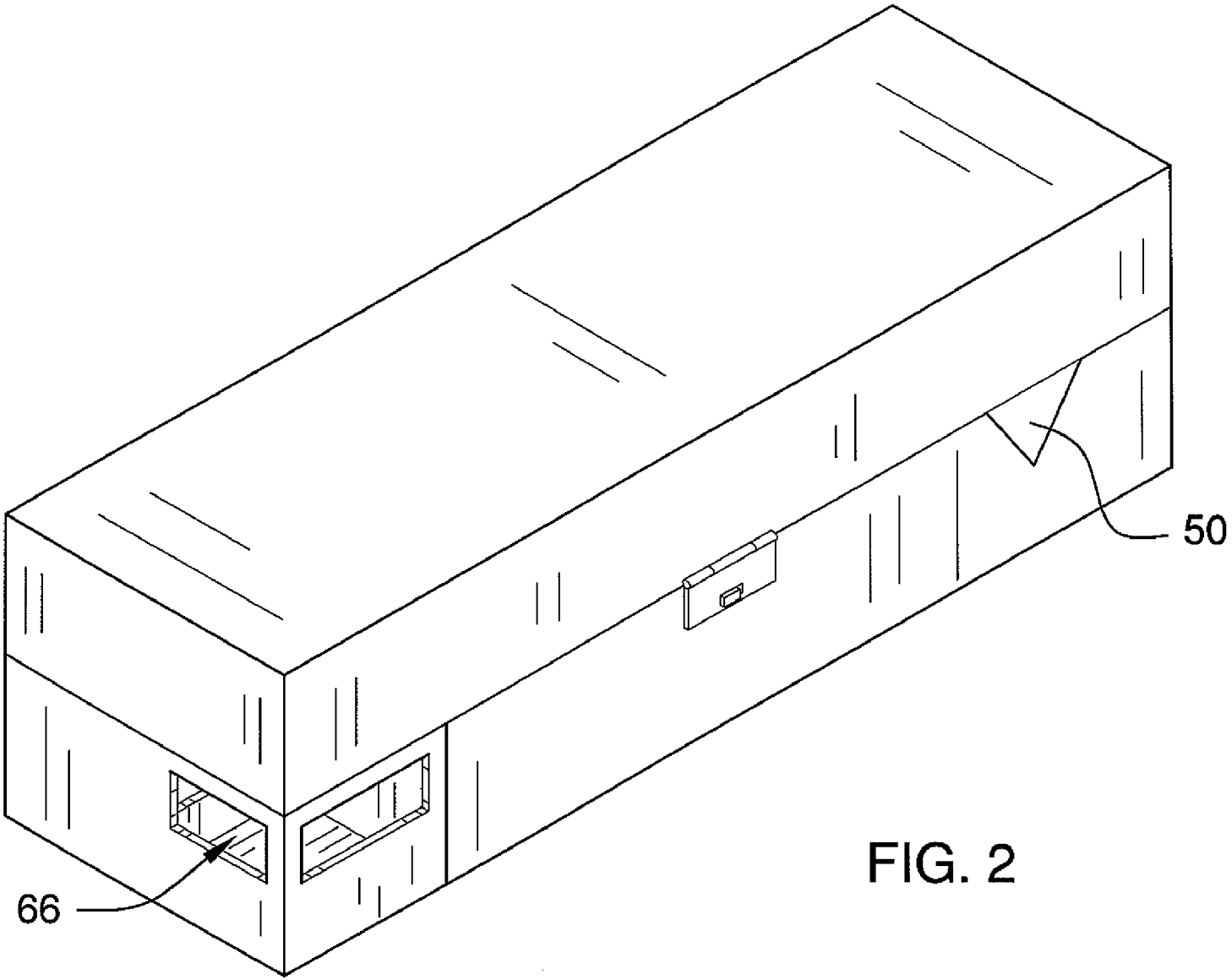
FIG. 2 is a top perspective view of the present invention the cover in a closed position.
Figure 3:
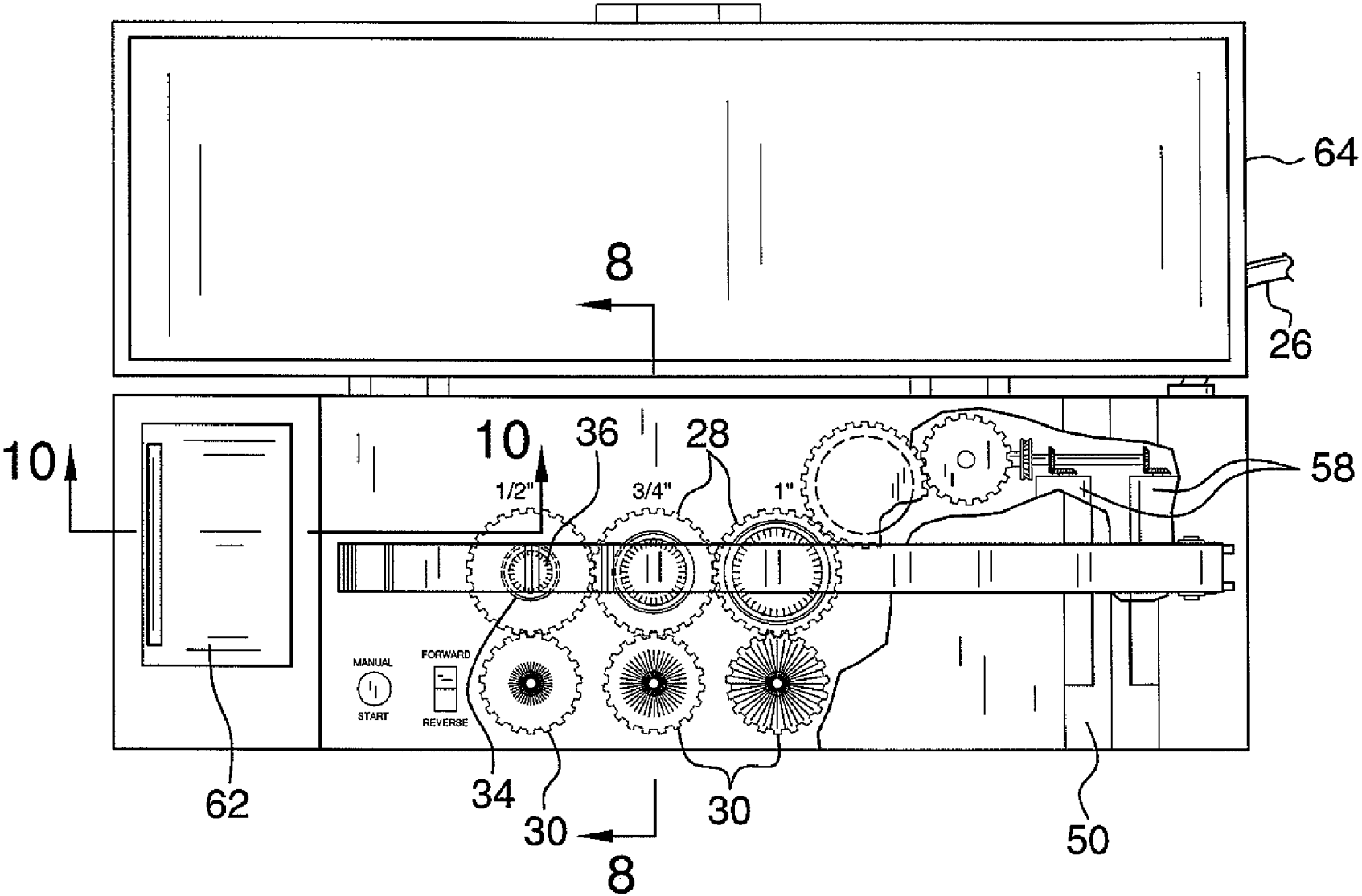
FIG. 3 is a top view of the present invention.

With reference now to the drawings, and in particular to FIGS. 1 through 10 thereof, a new pipe cleaning and scoring device embodying the principles and concepts of the present invention and generally designated by the reference numeral 10 will be described.

As best illustrated in FIGS. 1 through 10, the pipe preparation apparatus 10 generally comprises a housing 12 that has a first wall 14, a second wall 16 and a peripheral wall 18 that is attached to and extends between the first 14 and second 16 walls. A drive assembly 18 is mounted in the housing 12. The drive assembly 19 includes an electric motor 20 electrically coupled to a power supply 22 which may include batteries mounted within a battery compartment, not shown, and/or an electrical cord 26 electrically coupled to the motor and to a power outlet.

The drive assembly 19 further includes a plurality of gears 28, 30. Each of the gears 28, 30 is mechanically coupled to the motor 20. The plurality of gears 28, 30 includes a first set of gears 28 and a second set of gears 30. The first set of gears 28 comprises gear wheels positioned adjacent to the first wall 14 and oriented parallel to the first wall 14. The first gears 28 are engaged with each other and one of the first gears 28 is also engaged with the motor 20. Each of the second gears 30 is mechanically engaged with one the first gears 28. A plurality of primary drive shafts 32 is provided. Each of the second drive shafts 32 is provided. Each of the second gears 30 is mechanically engaged with one of the primary drive shafts 32. The primary drive shafts 32 each extend outwardly of the housing 12 through the first wall 14.

A plurality of scouring sleeves 34 is provided. Each of the scouring sleeves 34 is mechanically coupled to the drive assembly 19 and is rotated about an axis of the sleeves 34 when the drive assembly 19 is turned on. The sleeves 34 each have an inner surface comprising a plurality of inwardly extending bristles 36. A pipe 8 may be extended into one of the sleeves 34 and scoured and cleaned by the bristles 36 rotating around an outer surface of the pipe 8. Each of the sleeves 34 extends into the first wall 14 of the housing 12 and is coupled to one of the first gears 28. The sleeves 34 are rotated when the first gears 28 are rotated by the motor 20. Each of the scouring sleeves 34 of the plurality of scouring sleeves 34 has a diameter a different length with respect to other ones of the scouring sleeves 34.

A plurality of cleaning brushes 38 is also provided. Each of the cleaning brushes 38 includes a post 40 that has a first end 42 and a second end 44. The second end 44 is removably coupled to the drive assembly 19 and is rotated about its axis when the drive assembly 19 is turned on. In particular, the post 40 is removable coupled to one of the primary drive shafts 32. A plurality of bristles 46 is attached to the post 40 adjacent to the first end 42. The bristles 46 are extendable into a pipe 8 to scour and clean an inner surface of the pipe 8. Each of the cleaning brushes 38 of the plurality of cleaning brushes 38 has bristles 46 of a different length with respect to other ones of the cleaning brushes 38 to accommodate variously sized pipes 8 and pipe connectors.

A pipe cutting member is attached to the housing 12 and is used as needed to cut a pipe to alter a length of the pipe. The pipe cutting member 48 includes a pair of rollers 58 mounted in a trough 50 traversing the housing 12. The rollers 58 are aligned with the trough 50 and extend into the housing 12.

Figure 4:
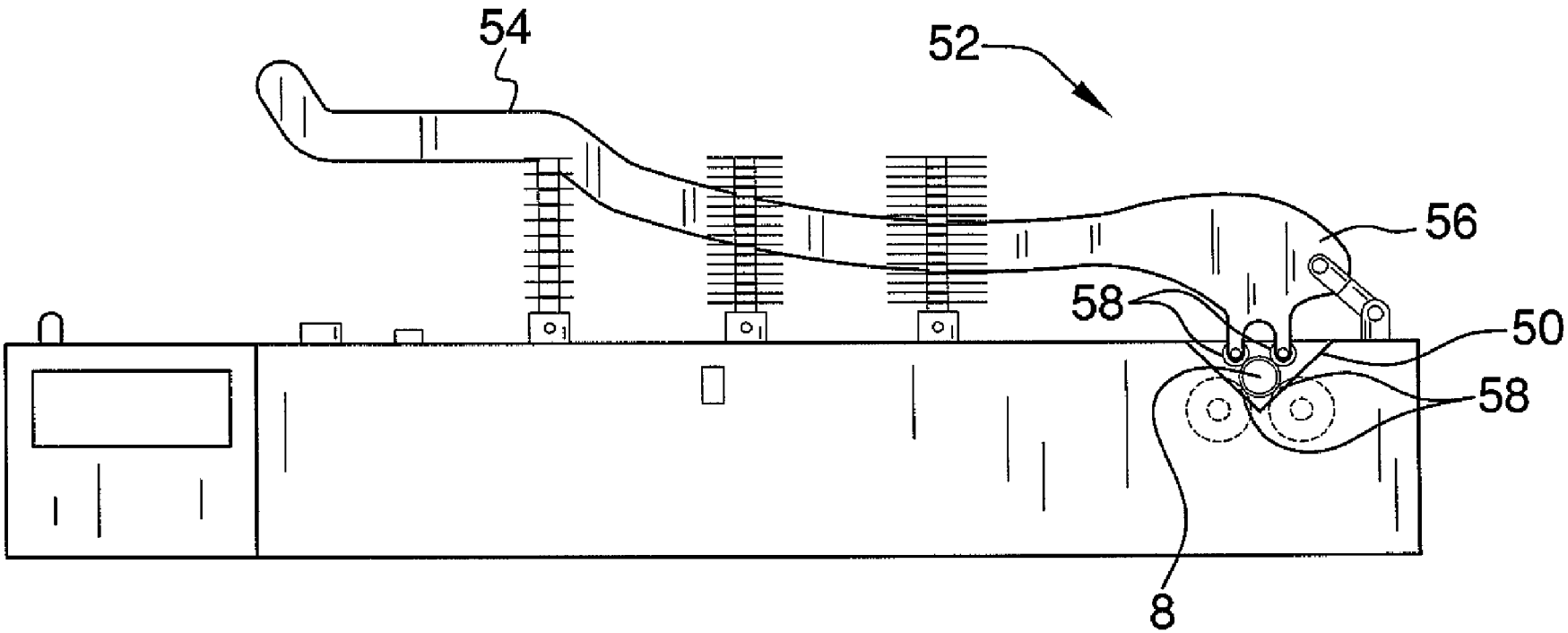
FIG. 4 is a front view of the present invention.
Figure 5:
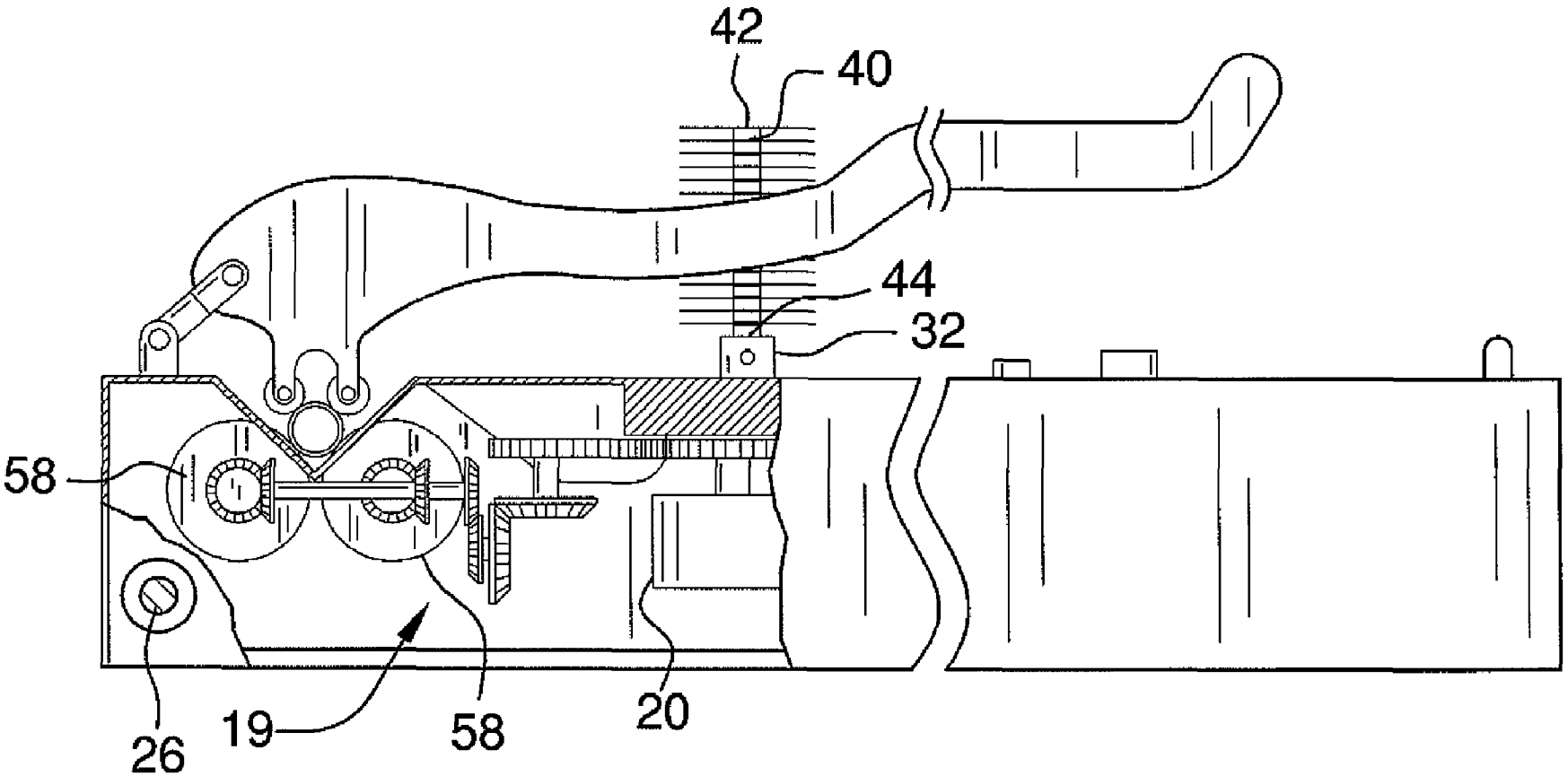
FIG. 5 is a broken rear view of the present invention.
Figure 6:
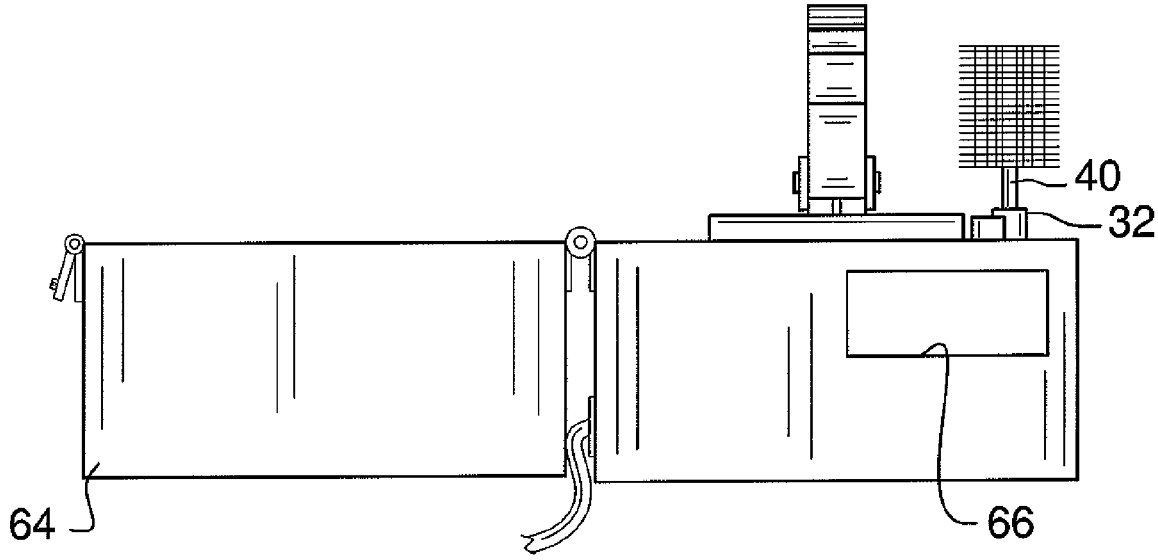
FIG. 6 is a right side view of the present invention.
Figure 7:
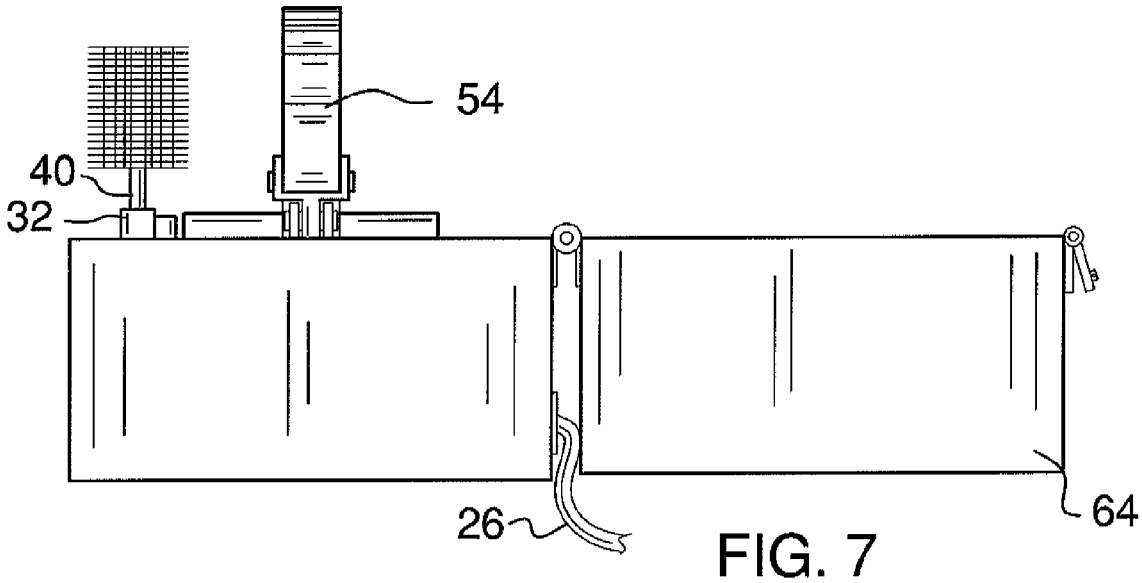
FIG. 7 is a left side view of the present invention.
Figure 8:
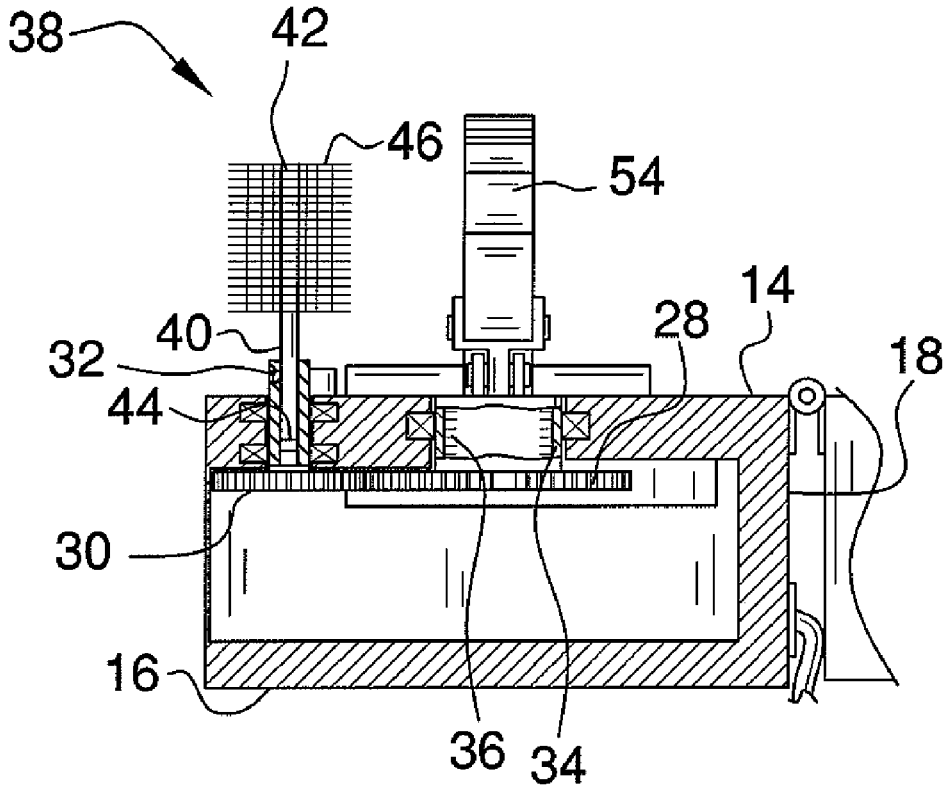
FIG. 8 is a cross-sectional view taken along line 8-8 of FIG. 3 of the present invention.
Figure 9:
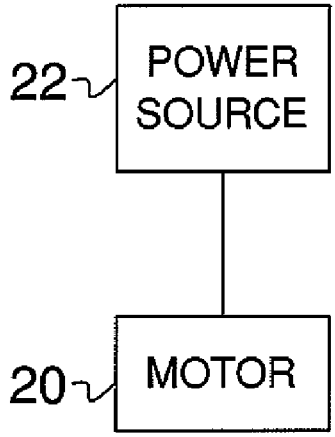
FIG. 9 is an electronic schematic view of the present invention.
Figure 10:
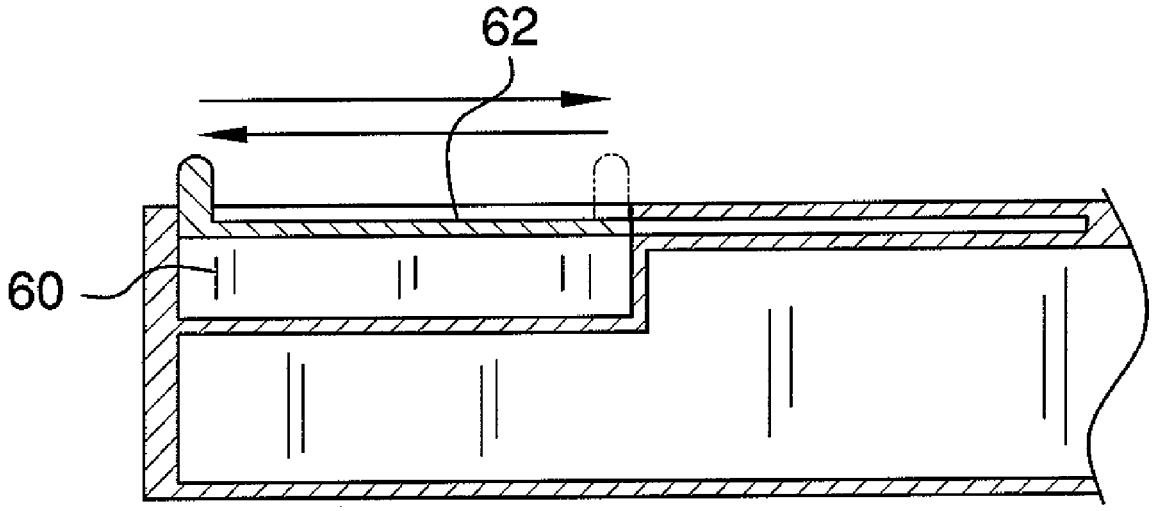
FIG. 10 is a cross-sectional view taken along line 10-10 of FIG. 3.

The rollers 58 are mechanically coupled to the drive assembly 19 and are rotated in a same direction with respect to each other when the drive assembly 19 is turned on. A biasing member 52 is mounted on the first wall 14 to bias a pipe 8 toward the rollers 58. The biasing member 52 comprises an arm 54 that has a first end 56 pivotally coupled to the first wall 14. The arm 54 is pivotable toward the trough 50 and includes one or more rotatably disc shaped cutting blades 48 that have an axis of rotation oriented parallel to a longitudinal axis of the trough 50. The cutting blades 48 and the rollers 58 are abutted against the pipe 8 as shown in FIG. 4 when the pipe 8 is being cut by the cutting blades 48. The rollers 58 are preferably geared for torque as opposed to speed as would be the case with the sleeve 34 and brushes 38.

A well 60 extends into the first wall 14 and a slidable door 62 is selectively positioned in an open orientation or a closed orientation with respect to said well. Welding flux may be stored in the well 60 for easy access to the welding flux. A cover 64 is hingedly coupled to the housing for selectively covering the first wall 14. A storage compartment 66 extends into the peripheral wall for holding flux or additional cleaning brushes.

In use, a pipe 8 is extendable into the sleeves 34 to score and clean the outer surface of the pipe 8 to ensure that a proper weld is made when it is attached to a connector or another pipe 8. The interior of the connector may be cleaned and scored in a like manner. If a pipe 8 is too long, it may be cut as needed by the blade.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pipe preparation assembly for preparing pipes to be joined together, said assembly comprising:

a housing having a first wall, a second wall and a peripheral wall being attached to and extending between said first and second walls;

a drive assembly being mounted in said housing, said drive assembly including:

a motor;

a plurality of gears, each of said gears being mechanically coupled to said motor, said plurality of gears including a first set of gears and a second set of gears, said first set of gears comprising gear wheels positioned adjacent to said first wall and oriented parallel to said first wall, each of said first gears being engaged with each other, one of said first gears being engaged with said motor, each of said second gears being mechanically engaged with one said first gears;

a plurality of primary drive shafts, each of said second gears being mechanically engaged with one of said primary drive shafts, each of said primary drive shafts extending outwardly of said housing through said first wall;

a plurality of scouring sleeves, each of said scouring sleeves being mechanically coupled to said drive assembly and being rotated about an axis of said sleeves when said drive assembly is turned on, each of said sleeves having an inner surface comprising a plurality of inwardly extending bristles, wherein a pipe may be extended into one of said sleeves and scoured and cleaned by said bristles rotating around an outer surface of the pipe, each of said sleeves extending into said first wall of said housing and being coupled to one of said first gears, said sleeves being rotated when said first gears are rotated by said motor;

a plurality of cleaning brushes, each of said cleaning brushes including:

a post having a first end and a second end, said second end being removably coupled to said drive assembly, said post being rotated about its axis when said drive assembly is turned on;

a plurality of bristles being attached to said post adjacent to said first end, said bristles being extendable into a pipe to scour and clean an inner surface of the pipe;

said posts being removable coupled to one of said primary drive shafts;

a pipe cutting member being attached to said housing and being used as needed to cut a pipe to alter a length of the pipe, said cutting member including:

a pair of rollers being mounted in a trough traversing said housing, said rollers being aligned with said trough and extending into said housing, said rollers being mechanically coupled to said drive assembly and being rotated in a same direction with respect to each other when said drive assembly is turned on;

a biasing member being mounted to said first wall and biasing a pipe toward said rollers, said biasing member comprising an arm having a first end pivotally coupled to said first wall, said arm being pivotable toward said trough; and at least one cutting blade being rotatably mounted on said biasing member, said at least one cutting member engaging the pipe when the pipe is positioned between said biasing member and said rollers, said at least one cutting blade includes a pair of disc shaped cutting blades each having an axis of rotation oriented parallel to a longitudinal axis of the trough.

2. The pipe preparation assembly according to claim 1, wherein each of said scouring sleeves of said plurality of scouring sleeves has a diameter a different length with respect to other ones of said scouring sleeves.

3. The pipe preparation assembly according to claim 2, wherein each of said cleaning brushes of said plurality of cleaning brushes has bristles of a different length with respect to other ones of said cleaning brushes.

4. The pipe preparation assembly according to claim 1, wherein each of said cleaning brushes of said plurality of cleaning brushes has bristles of a different length with respect to other ones of said cleaning brushes.

5. The pipe preparation assembly according to claim 1, further including a storage compartment extending into said peripheral wall.

6. A pipe preparation assembly for preparing pipes to be joined together, said assembly comprising:

a housing having a first wall, a second wall and a peripheral wall being attached to and extending between said first and second walls;

a drive assembly being mounted in said housing, said drive assembly including:

a motor;

a plurality of gears, each of said gears being mechanically coupled to said motor, said plurality of gears including a first set of gears and a second set of gears, said first set of gears comprising gear wheels positioned adjacent to said first wall and oriented parallel to said first wall, each of said first gears being engaged with each other, one of said first gears being engaged with said motor, each of said second gears being mechanically engaged with one said first gears;

a plurality of primary drive shafts, each of said second gears being mechanically engaged with one of said primary drive shafts, each of said primary drive shafts extending outwardly of said housing through said first wall;

a plurality of scouring sleeves, each of said scouring sleeves being mechanically coupled to said drive assembly and being rotated about an axis of said sleeves when said drive assembly is turned on, each of said sleeves having an inner surface comprising a plurality of inwardly extending bristles, wherein a pipe may be extended into one of said sleeves and scoured and cleaned by said bristles rotating around an outer surface of the pipe, each of said sleeves extending into said first wall of said housing and being coupled to one of said first gears, said sleeves being rotated when said first gears are rotated by said motor, each of said scouring sleeves of said plurality of scouring sleeves having a diameter a different length with respect to other ones of said scouring sleeves;

a plurality of cleaning brushes, each of said cleaning brushes including:

a post having a first end and a second end, said second end being removably coupled to said drive assembly, said post being rotated about its axis when said drive assembly is turned on, said post being removable coupled to one of said primary drive shafts;

a plurality of bristles being attached to said post adjacent to said first end, said bristles being extendable into a pipe to scour and clean an inner surface of the pipe;

each of said cleaning brushes of said plurality of cleaning brushes having bristles of a different length with respect to other ones of said cleaning brushes;

a pipe cutting member being attached to said housing and being used as needed to cut a pipe to alter a length of the pipe, said cutting member including:

a pair of rollers mounted in a trough traversing said housing, said rollers being aligned with said trough and extending into said housing, said rollers being mechanically coupled to said drive assembly and being rotated in a same direction with respect to each other when said drive assembly is turned on;

a biasing member being mounted on the first wall to bias a pipe toward the rollers, said biasing member comprising an arm having a first end pivotally coupled to said first wall, said arm being pivotable toward said trough and including one or more rotatably disc shaped cutting blades having an axis of rotation oriented parallel to a longitudinal axis of the trough, said cutting blades being abutted against the pipe when said pipe is positioned on said rollers and cutting said pipe; and a storage compartment extending into said peripheral wall.

7. A pipe preparation assembly for preparing pipes to be joined together, said assembly comprising:

a housing having a first wall, a second wall and a peripheral wall being attached to and extending between said first and second walls;

a drive assembly being mounted in said housing, said drive assembly including:

a motor;

a plurality of gears, each of said gears being mechanically coupled to said motor, said plurality of gears including a first set of gears and a second set of gears, said first set of gears comprising gear wheels positioned adjacent to said first wall and oriented parallel to said first wall, each of said first gears being engaged with each other, one of said first gears being engaged with said motor, each of said second gears being mechanically engaged with one said first gears;

a plurality of primary drive shafts, each of said second gears being mechanically engaged with one of said primary drive shafts, each of said primary drive shafts extending outwardly of said housing through said first wall;

a plurality of scouring sleeves, each of said scouring sleeves being mechanically coupled to said drive assembly and being rotated about an axis of said sleeves when said drive assembly is turned on, each of said sleeves having an inner surface comprising a plurality of inwardly extending bristles, wherein a pipe m ay be extended into one of said sleeves and scoured and cleaned by said bristles rotating around an outer surface of the pipe, each of said scouring sleeves of said plurality of scouring sleeves has a diameter a different length with respect to other ones of said scouring sleeves, each of said sleeves extending into said first wall of said housing and being coupled to one of said first gears, said sleeves being rotated when said first gears are rotated by said motor;

a plurality of cleaning brushes, each of said cleaning brushes including:

a post having a first end and a second end, said second end being removably coupled to said drive assembly, said post being rotated about its axis when said drive assembly is turned on, said posts being removable coupled to one of said primary drive shafts;

a plurality of bristles being attached to said post adjacent to said first end, said bristles being extendable into a pipe to scour and clean an inner surface of the pipe; and each of said cleaning brushes of said plurality of cleaning brushes has bristles of a different length with respect to other ones of said cleaning brushes.

8. The pipe preparation assembly according to claim 7, wherein each of said cleaning brushes of said plurality of cleaning brushes has bristles of a different length with respect to other ones of said cleaning brushes.

9. The pipe preparation assembly according to claim 7, a pipe cutting member being attached to said housing and being used as needed to cut a pipe to alter a length of the pipe.

10. The pipe preparation assembly according to claim 9, wherein said cutting member includes a pair of rollers being mounted in a trough traversing said housing, said rollers being aligned with said trough and extending into said housing, said rollers being mechanically coupled to said drive assembly and being rotated in a same direction with respect to each other when said drive assembly is turned on, a biasing member being mounted to said first wall and biasing a pipe toward said rollers, at least one cutting blade being rotatably mounted on said biasing member, said at least one cutting member engaging the pipe when the pipe is positioned between said biasing member and said rollers.

11. The pipe preparation assembly according to claim 10, wherein said biasing member comprise an arm having a first end pivotally coupled to said first wall, said arm being pivotable toward said trough.

12. The pipe preparation assembly according to claim 11, wherein said at least one cutting blade includes a pair of disc shaped cutting blades each having an axis of rotation oriented parallel to a longitudinal axis of the trough.

13. The pipe preparation assembly according to claim 7, further including a storage compartment extending into said peripheral wall.

* * * * *